United States Patent [19]

Byrne, Jr.

[11] 4,202,208

[45] May 13, 1980

[54] HYDRAULIC TORQUE INDICATOR

[75] Inventor: Joseph H. Byrne, Jr., Houston, Tex.

[73] Assignee: Joy Manufacturing Company, Pittsburgh, Pa.

[21] Appl. No.: 953,736

[22] Filed: Oct. 23, 1978

[51] Int. Cl.[2] ..... B25B 23/14

[52] U.S. Cl. ..... 73/139

[58] Field of Search ..... 73/136 D, 139, 143

[56] References Cited

U.S. PATENT DOCUMENTS 4,137,758 2/1979 Rodland ..... 73/139

*Primary Examiner*—Charles A. Ruehl

*Attorney, Agent, or Firm*—Thomas H. Murray

[57] ABSTRACT

A hydraulic torque indicator incorporating a gage readable in foot-pounds, which is adjustable for any length torque arm by the use of a link arm and an adjustable hydraulic cylinder connected in a trigonometric configuration which increases the pressure output to the torque gage as the torque arm to which the indicator is connected increases in length, thereby enabling the indicator to give an accurate indication of torque for any length torque arm.

14 Claims, 9 Drawing Figures

HYDRAULIC TORQUE INDICATOR

BACKGROUND OF THE INVENTION

While not limited thereto, the present invention is particularly adapted for use with power-pipe tongs used in oil well drilling operations. Such power tongs are provided with a torque indicator device used to determine the amount of torque the tong applies to a drill pipe in making up a drill string. In the usual case, the torque indicator device is attached at one end to a radially-extending arm on the tong and at the other end to a fixed point such as the oil well drilling derrick. The arrangement is such that when torque is applied to a drill string by an internal motor built within the tong, the entire assembly will tend to rotate about the pipe and is retrained from doing so only by the connection of the torque indicator device between the radially-extending arm and the derrick or other fixed point of connection.

Torque indicators of this type basically comprise a hydraulic cylinder arranged to pressurize liquid in response to a torque-producing force, and a pressure gage connected to the cylinder which is calibrated in foot-pounds. A difficulty with prior art torque indicator devices of this type is that they are calibrated for a single torque arm length, meaning that a different torque indicator device is needed for each torquing tool of a specified moment arm.

SUMMARY OF THE INVENTION

In accordance with the present invention, a torque indicator device is provided which is adjustable for any length torque arm. In one embodiment of the invention shown herein, it comprises a link arm pivotally connected at one end to one corner of a triangularly-shaped calibration plate. Pivotally connected between the other end of the link arm and a second corner of the triangularly-shaped calibration plate is a hydraulic cylinder and piston assembly. A force-producing torque is applied between a third corner of the triangularly-shaped plate and the end of the link arm opposite its pivotal connection to the calibration plate.

By varying the volume of the fluid in the hydraulic cylinder between its piston and an end of the cylinder through which a piston rod passes, the angular relationship between the hydraulic cylinder assembly, the link arm and the triangularly-shaped calibration plate can be varied, depending upon the length of the torque arm to which a turning force is applied. The arrangement is such that the force on the piston tending to pressurize the fluid within the cylinder is increased as the length of the torque arm is increased with the result that the same torque gage calibrated in foot-pounds can be used for any length torque arm.

The above and other objects and features of the invention will become apparent from the following detailed description taken in connection with the accompanying drawings which form a part of this specification, and in which.

Figure 1:
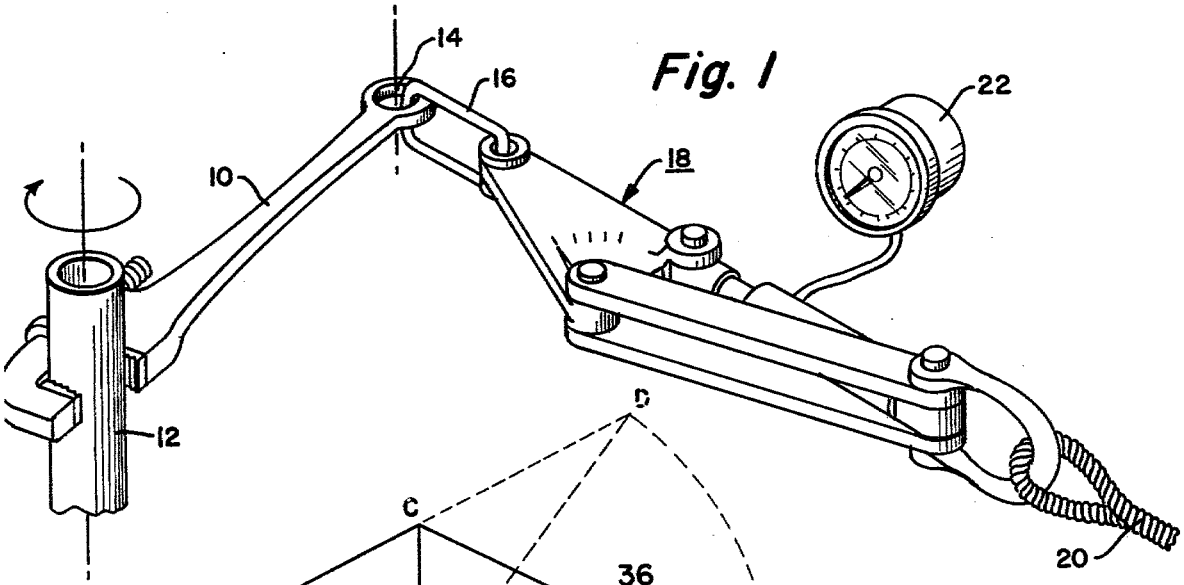
FIG. 1 is a perspective view of the torque indicator of the invention as applied to a conventional wrench.

With reference now to the drawings, and particularly to FIG. 1, a wrench 10 is shown secured to a pipe 12. At the end of the wrench 10 opposite the pipe 12 is an opening 14 connected through link 16 to the torque indicator of the invention, generally indicated by the reference numeral 18. The other end of the torque indicator is connected through a cable 20 or the like to a winch or other similar device for applying a turning force to the wrench 10 through indicator 18 of the invention.

The torque indicator 18, hereinafter described in detail with reference to FIGS. 2 and 3 includes a pressure gage 22 calibrated in foot-pounds. As will be seen, the indicator device of the invention can be adjusted such that the gage 22 will indicate the correct torque in foot-pounds regardless of the length of the moment arm represented by the wrench 10 in FIG. 1.

Figure 3:
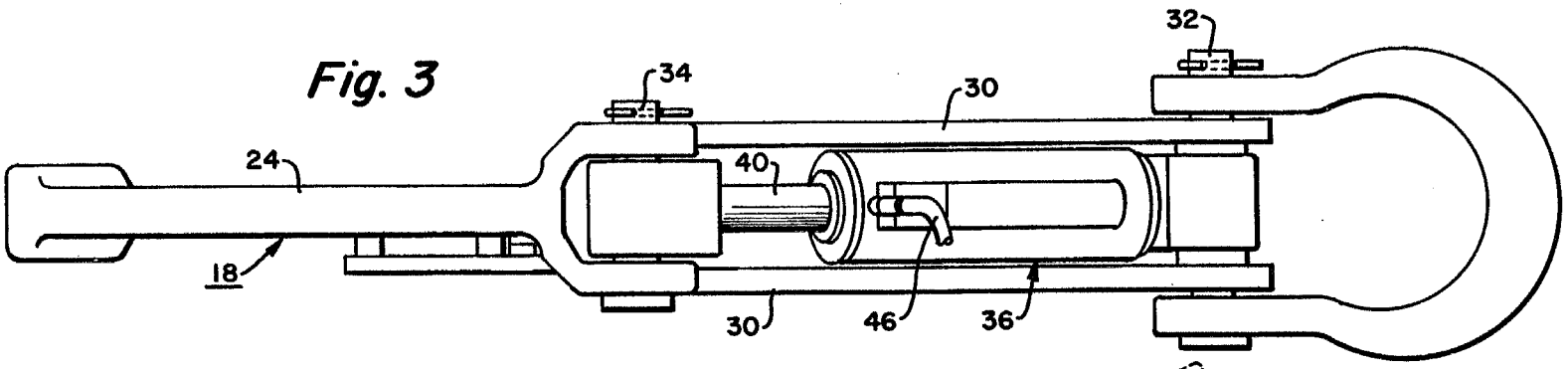
FIG. 3 is a top view of the torque indicator shown in FIG. 2.
Figure 2:
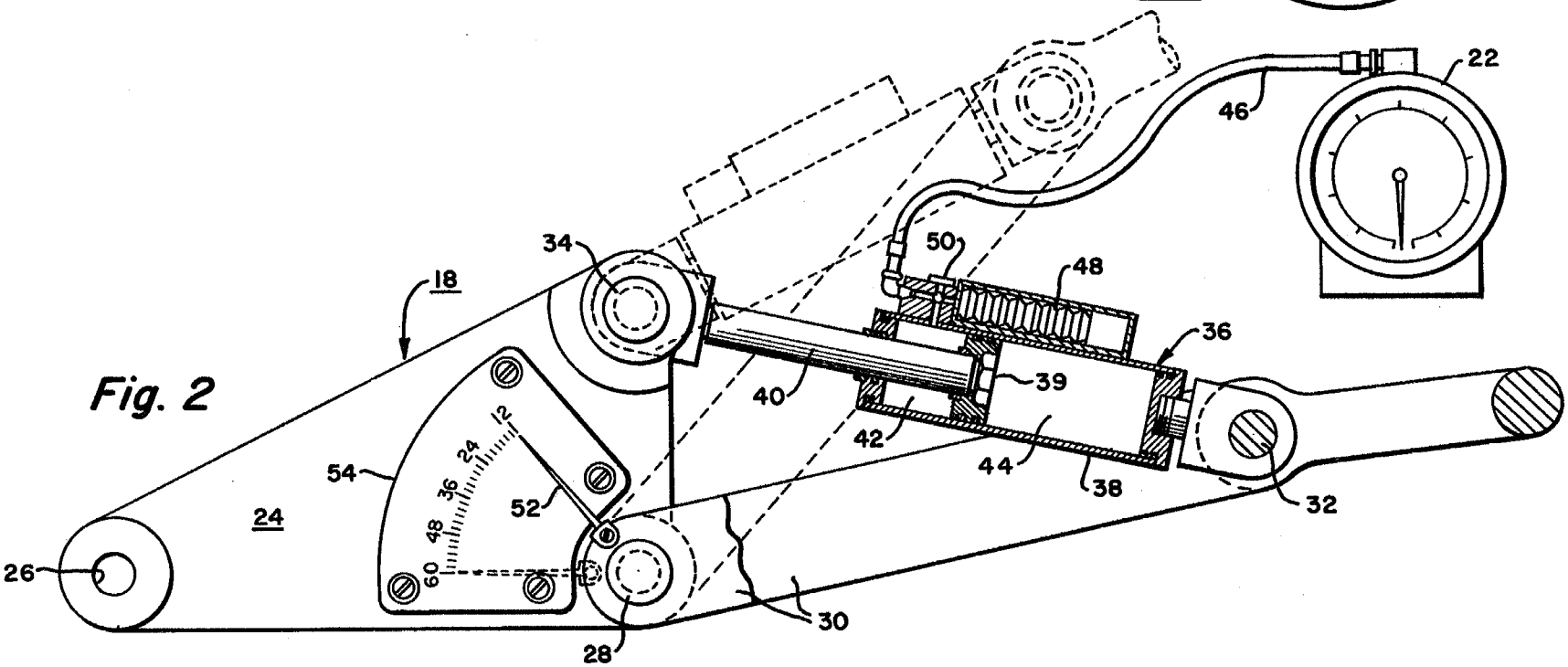
FIG. 2 is a side view of the torque indicator of the invention.

With reference now to FIGS. 2 and 3, the torque indicator 18 includes a support member preferably in the form of a triangular plate 24. At one corner of the triangular plate 24 is a hole or opening 26 adapted for connection to a torque arm or to a pulling device. In another corner of the triangular plate 24 is a first pivot pin 28 which supports link arms 30. Link arms 30 are provided at their other ends with a second pivot pin 32; and between the pivot pin 32 and pivot pin 34 at the third corner of the triangular plate 24 is a hydraulic cylinder assembly, generally indicated by the reference numeral 36.

The hydraulic cylinder assembly 36 includes a cylinder 38 whose end is pivotally connected to the pivot pin 32 and a piston 39 reciprocable therein. Connected to the piston 39 is a piston rod 40 which passes through the end of the cylinder 38 opposite the pivot pin 32 and is connected at its free end to the pivot pin 34. The forward chamber 42 of the cylinder 38 is filled with hydraulic fluid; while the rear chamber 44 contains air and may be vented to the atmosphere. Chamber 42 is connected through conduit 46 to the pressure gage 22. However, it may be selectively connected to an expansible reservoir in the form of a bellows, generally indicated by the reference numeral 48 in FIG. 2. That is, when valve 50 is opened, the bellows 48 is connected to chamber 42; however when the valve 50 is closed, chamber 42 is disconnected from bellows 48 and is connected only to the pressure gage 22. It will be appreciated that when the valve 50 is opened, the link arms 30 may be rotated about pivot pin 28 from the full-line position in FIG. 2 to the extreme broken-line position shown wherein the longitudinal axis of the hydraulic cylinder assembly 36 is aligned with the axes of pivot pin 34 and opening 26. As link arms 30 rotate in a counterclockwise direction as viewed in FIG. 2, the piston 39 will move to the right, thereby drawing liquid from reservoir 48 into chamber 42. Conversely, when link arms 30 rotate in a clockwise direction, liquid will be expelled from the chamber 42 back into the bellows 48.

Connected to one of the link arms 30 is a calibrator needle 52 disposed above a calibration plate 54 calibrated in inches. In the use of the indicator device of the invention, the torque arm length is initially determined. Thereafter, valve 50 is opened to connect bellows 48 to chamber 42 and link arms 30 are rotated to a position where the calibrator needle 52 points to the length of the torque arm. Thus, if the torque arm is 1 foot in length, link arms 30 are rotated until the calibrator needle 52 is aligned with the 12-inch graduation. Similarly, if the torque arm length is 5 feet, link arms 30 are rotated to the position where the needle 52 is aligned with the 60-inch graduation. Once the link arms 30 have been rotated to the desired torque arm length, valve 50 is then closed to lock both arms 30 and cylinder assembly in position. In this respect, the angular relationship of the cylinder assembly with the link arms can be varied when, and only when, valve 50 is open.

Figure 4:
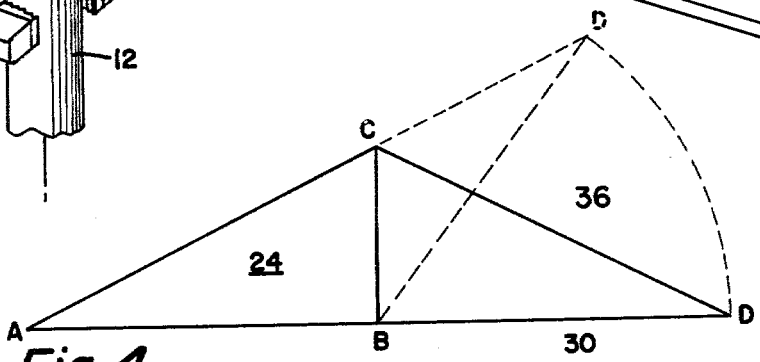
FIG. 4 is a diagram showing the geometry of the various elements of the torque indicator of the invention in its two extreme possible configurations.

The geometry of the torque indicator of the invention is shown in FIG. 4 wherein triangle ABC represents the calibration plate; line B-D represents the link arms 30 and line C-D represents the hydraulic cylinder assembly 36. Assuming that points A and D are connected to the end of wrench 10 and cable 20 in FIG. 1, for example, a pulling force equal to the force on the torque arm 10 will exist between these points. When valve 50 is opened and link arms 30 are rotated upwardly into the broken-line position shown in FIG. 2, the positions of lines C-D and B-D will be as indicated by the broken lines in FIG. 4.

For purposes of explanation, it will be assumed that the area of piston 39 is 1 square inch and that the pressure gage 22 is calibrated such that for each pound per square inch pressure, it will read 5 foot-pounds. If it is further assumed that the torque arm of wrench 10 shown in FIG. 1 is 5 feet and that the pull exerted by the cable 20 is 10 pounds, the torque will be 10 pounds times 5 feet or 50 foot-pounds. This means that the pressure exerted on the fluid in chamber 42 must be 10 pounds per square inch assuming, again, that the gage 22 registers 5 foot-pounds for each square inch of pressure (i.e., 10 psi$\times$5 foot-pounds registers 50 foot-pounds of torque).

Figure 5:
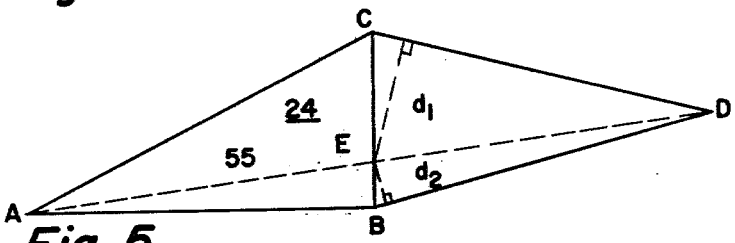
FIG. 5 is a diagram showing the geometry of the various parts of the torque indicator for a torque arm length of one foot.
Figure 6:
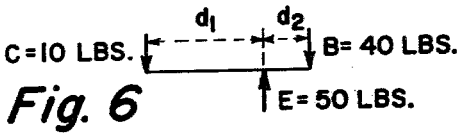
FIG. 6 is a force vector diagram showing the loads at various points in the torque indicator for the conditions assumed in FIG. 5.

Now, if it is desired to develop 50 foot-pounds of torque, with a 1-foot wrench rather than a 5-foot wrench as assumed above, the pull exerted by the cable 20 must be 50 pounds. However, the liquid within chamber 42 still must be pressurized to 10 pounds per square inch in order for the gage to read 50 foot-pounds. Under these circumstances, the valve 50 is opened and the cylinder length is adjusted by rotating link arms 30 until the calibrator needle points to 12 inches. This changes the geometry as shown in FIG. 5. In this example, the line of pull 55 (which represents 50 pounds) passes through points A, D and E as the true, yet imaginary, load. The reaction at point E along line A-D is 50 pounds. In order to maintain equilibrium, the sum of the moments about point E caused by the reaction loads on the cylinder represented by line C-D and the link represented by line B-D must equal zero. This is illustrated in FIG. 6 where the reaction at point E as indicated as 50 pounds and the reaction through point C as 10 pounds. Under these circumstances, the reaction at point B is 40 pounds. This is possible only if distance $d_1$ is four times greater than distance $d_2$. The change in the difference between $d_1$ and $d_2$ depends, of course, upon the length of cylinder assembly 36 represented by line C-D in FIG. 5. Thus, even though the pull on cable 20 of FIG. 1 is 50 pounds rather than 10 pounds as in the example previously given, the force on piston 39 is still 10 pounds to indicate a torque of 50 foot-pounds.

Figure 7:
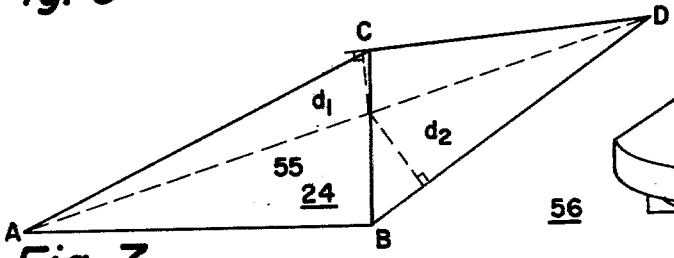
FIG. 7 is a diagram showing the geometry of the torque indicator of the invention for a torque arm length of three feet.
Figure 8:
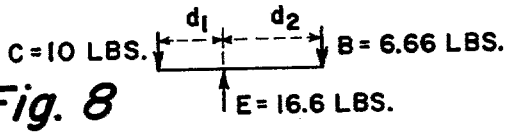
FIG. 8 is a force vector diagram illustrating the forces on the various parts of the torque indicator for the conditions assumed in FIG. 7.

Now, if it is assumed that the moment arm of the wrench 10 is 3 feet and that 50 foot-pounds of torque are required, the pulling force exerted by the cable 20 must be 16.66 pounds. However, in order for the gage to read 50 foot-pounds, the force on piston 39 must still be 10 pounds. Under these circumstances, the indicating device assumes the geometry of FIG. 7 wherein the ratio of the dimensions $d_1$ and $d_2$ about point E has been changed by adjusting the length of cylinder assembly 36, represented by the line C-D, until the calibrator needle 52 points to 36 inches. The load at point B is now 6.6 pounds; however the load at point C is again 10 pounds to cause the pressure gage 22 to again indicate 50 foot-pounds with $d_2$ being 1.51 times longer than $d_1$ as shown in FIG. 8. Of course, if the torque is 100 foot-pounds, for example, then the force at point C must be 20 pounds for all torque arm lengths; and this is achieved by adjusting the positions of link arms 30 as described above.

Figure 9:
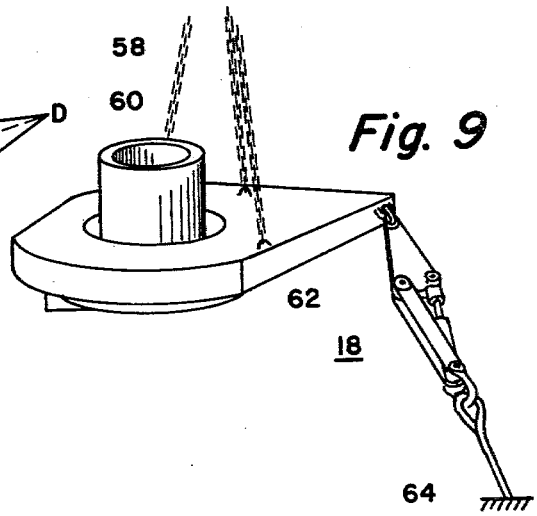
FIG. 9 illustrates an application of the torque indicator of the invention to a power tong for oil well drilling operations.

With reference now to FIG. 9, the use of the invention as applied to a power tong for an oil well drilling rig is illustrated. In this case, the power tongs, generally indicated by the reference numeral 56, is suspended by chains 58 and is provided with an internal hydraulic motor which drives rotary gripper jaws, not shown. The jaws, in turn, engage a pipe 60 to thread it onto a drill stem. The power tong is provided with a radially-extending portion 62 which forms a moment arm; and the torque indicating device 18 of the invention is connected between the arm 62 and a fixed point 64. The only difference between this application and the wrench shown in FIG. 1, for example, is that the turning force applied to the tong is generated by an internal hydraulic motor.

Although the invention has been shown in connection with certain specific embodiments, it will be readily apparent to those skilled in the art that various changes in form and arrangement of parts may be made to suit requirements without departing from the spirit and scope of the invention. In this respect, it will be apparent that instead of attaching a pressure gage 22 to the cylinder 38, any pressure-responsive device, such as a pressure-responsive electrical switch, could be used in its place. For example, if a pressure-responsive switch is used, that switch could be incorporated into electrical circuitry for indicating torque above or below a predetermined limit.

I claim as my invention:

1. A torque indicator comprising a support member, a link arm having one end pivotally connected to said support member about a first pivot axis, fluid cylinder means having one end pivotally connected to said member about a second pivot axis which is parallel to but spaced from said first pivot axis, the other end of the fluid cylinder means being pivotally connected to said link arm intermediate its ends about a third pivot axis which is parallel to the first and second pivot axes, means for causing a pulling force equal to the force on a torque arm to exist between a point on said member and a point on the other end of said link opposite said first pivot axis, said point on the member being spaced from said first and second pivot axes so as to form a triangular configuration therewith, fluid interposed between a reciprocable piston in said cylinder means and an end of a cylinder in which it reciprocates such that the fluid will be pressurized when said pulling force exists between the point on the support member and the point on the other end of said link, means for varying the volume of said fluid to thereby vary the angular relationship between said fluid cylinder means and said link arm, and pressure-responsive means adapted for connection to the end of the cylinder containing said fluid.

2. The torque indicator of claim 1 wherein said fluid comprises a liquid.

3. The torque indicator of claim 1 wherein said support member comprises a triangular element, said first and second pivot axes being at two corners of the triangular element, and said point on the member being at the third corner of the triangular element.

4. The torque indicator of claim 3 wherein said triangular element forms a right angle with the distance between said first and second pivot axes forming one leg of the right triangle, the distance between said first pivot axis and said point on the triangular element forms the other leg, and the distance between said point on the triangular element and the second pivot axis forms the hypotenuse of the right triangle.

5. The torque indicator of claim 1 including a dial on said support member calibrated in torque arm length units, and a pointer secured to said link arm and rotatable therewith about said first pivot axis, the pointer sweeping over said dial to indicate the torque arm length to which the indicator has been set by varying the volume of fluid within said fluid cylinder means.

6. The torque indicator of claim 1 wherein said link arm and said fluid cylinder means form a triangle with said support member.

7. The torque indicator of claim 1 wherein the means for varying the volume of the fluid in said cylinder means comprises an expansible fluid reservoir, and valve means for selectively connecting the cylinder to the reservoir, the arrangement being such that when the valve means is open, the angular relationship between the link arm and the fluid cylinder means can be altered with fluid flowing into or out of the reservoir.

8. The torque indicator of claim 7 wherein said expansible fluid reservoir comprises an expansible bellows.

9. The torque indicator of claim 1 wherein said fluid cylinder means comprises a hydraulic cylinder, a piston reciprocable within said cylinder, a piston rod connected to said piston and extending through an end of the cylinder, pivot attachment means on the end of the piston rod opposite the piston, pivot attachment means on the end of the cylinder opposite the piston rod, and means pivotally connecting the respective pivot attachment means to the support member and the link arm about said second and third pivot axes.

10. The torque indicator of claim 9 wherein said fluid comprises oil which surrounds said piston rod, the side of the cylinder opposite the piston rod containing air.

11. The torque indicator of claim 1 wherein the pressure-responsive means comprises a torque gage.

12. The torque indicator of claim 11 wherein the torque gage comprises a pressure gage calibrated to read in foot-pounds.

13. A torque indicator comprising a support member, a link arm having one end connected to said support member, fluid pressure producing means connected between said support member and a point on said link arm, means for causing a pulling force equal to the turning force applied to a torque arm to exist between a point on said support member and the end of said link arm opposite its connection to said support member whereby the pulling force will cause said fluid pressure producing means to pressurize fluid in an amount dependent upon the magnitude of said force, means for varying the length of said fluid pressure producing means between its connection to the support member and said point on the link arm to thereby vary the angular relationship between said link arm and said fluid pressure producing means to compensate for variations in the length of a torque arm to which said turning force is applied, and pressure-responsive means connected to said pressure producing means.

14. The torque indicator of claim 13 wherein said pressure responsive means comprises a torque gage.

* * * * *